US011351807B2

(12) United States Patent
Ardinger et al.

(10) Patent No.: US 11,351,807 B2
(45) Date of Patent: Jun. 7, 2022

(54) METHOD OF STENCILING WITH A MAGNETIC STENCILING APPARATUS

(71) Applicants: Karen Ardinger, Leominster, MA (US); Jeffery Ardinger, Leominster, MA (US)

(72) Inventors: Karen Ardinger, Leominster, MA (US); Jeffery Ardinger, Leominster, MA (US)

( * ) Notice: Subject to any disclaimer, the term of this patent is extended or adjusted under 35 U.S.C. 154(b) by 37 days.

(21) Appl. No.: 16/674,117

(22) Filed: Nov. 5, 2019

(65) Prior Publication Data

US 2020/0139740 A1 May 7, 2020

Related U.S. Application Data

(60) Provisional application No. 62/755,816, filed on Nov. 5, 2018.

(51) Int. Cl.

| | |
|---|---|
| ***B41M 1/12*** | (2006.01) |
| ***B41N 1/24*** | (2006.01) |
| ***B41L 29/02*** | (2006.01) |
| ***B41F 27/02*** | (2006.01) |
| ***B41F 15/36*** | (2006.01) |
| ***B44D 2/00*** | (2006.01) |

(52) U.S. Cl.

CPC ..... *B41N 1/248* (2013.01); *B41F 15/36* (2013.01); *B41F 27/02* (2013.01); *B41L 29/02* (2013.01); *B41M 1/12* (2013.01); *B44D 2/007* (2013.01)

(58) Field of Classification Search

CPC ..... B44D 2/007; B43L 13/201; B41N 1/248

USPC ..... 101/114, 127, 127.1, 128, 128.1; 434/87

See application file for complete search history.

(56) References Cited

U.S. PATENT DOCUMENTS 2,935,936 A * 5/1960 Woodring ..... B05C 17/06 101/128.1
3,633,286 A * 1/1972 Maurer ..... B43L 13/206 434/87
4,652,337 A * 3/1987 Picone ..... B05C 17/06 101/128.21

(Continued)

FOREIGN PATENT DOCUMENTS

GB 2156739 A * 10/1985 ..... B41F 15/02

*Primary Examiner* — Leslie J Evanisko

(74) *Attorney, Agent, or Firm* — Louis J. Franco; Law Office of Louis J. Franco

(57) ABSTRACT

A method of stenciling a stenciled graphic in a desired position and orientation on the graphic-display surface of a substrate includes providing at least one stencil template defining the stenciled graphic and at least one guide element including mutually-space template positioning indicia. Both the stencil template and the guide element are magnetically attracted to the substrate. The guide element is magnetically affixed to the graphic display surface in a desired location and orientation. The stencil template is magnetically affixed to the graphic-display surface in a location selected with positioning reference to at least one template-positioning indicium of the guide element. With or without the guide element still affixed, pigment is applied to the graphic-display surface through the at least one stencil template to impart to the graphic-display surface the desired stenciled graphic. The at least one stencil template is then removed from the graphic-display surface.

3 Claims, 15 Drawing Sheets

(56) References Cited

U.S. PATENT DOCUMENTS

| | | | | | |
|---|---|---|---|---|---|
| 5,000,688 | A * | 3/1991 | Clamp | G09B 11/04 | 101/127 |
| 6,142,071 | A * | 11/2000 | Fexer | B05C 17/06 | 101/114 |
| 6,237,240 | B1 * | 5/2001 | Nelson | B43L 13/205 | 33/563 |
| 6,820,546 | B2 * | 11/2004 | Wynne | B05B 12/24 | 101/129 |
| 2010/0300313 | A1 * | 12/2010 | Disbrow | B05C 17/06 | 101/128 |

* cited by examiner

1 Line up guides (WBGS) to edges of the chalkboard and place long guide (WGBD) in the notches. Place your magnetic letters, aligning to the top of the long guide (WGBD). Fill in magnet letters with your Plata Chalk Markers.

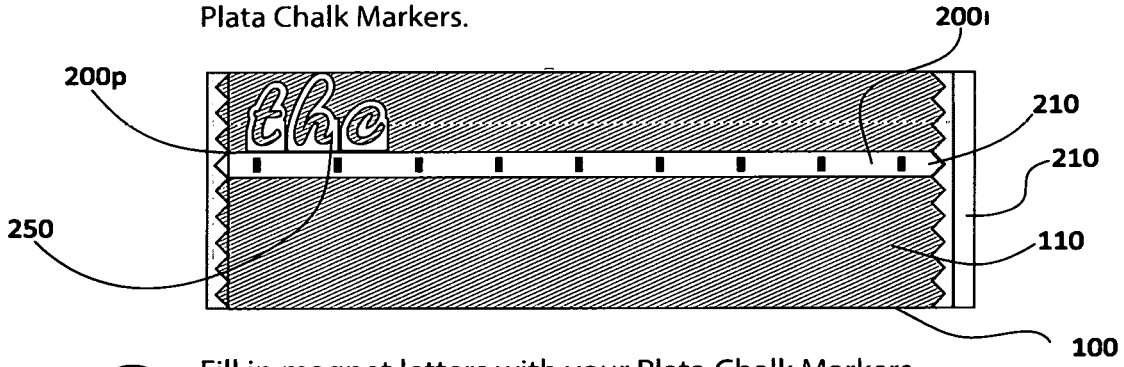

2 Fill in magnet letters with your Plata Chalk Markers. Remove the letters from the top of the letter, using the guide to push against.

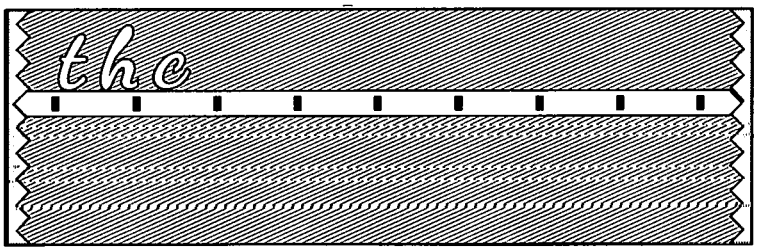

3 Move the guide & repeat with your next line of letters.

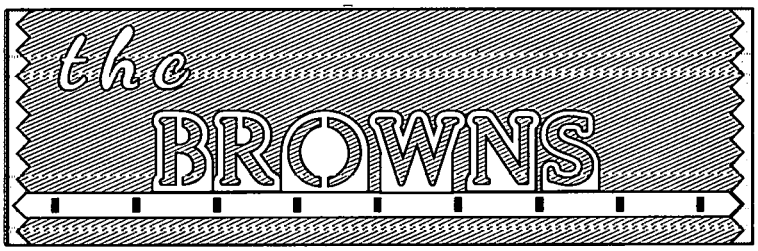

*FIG.8*

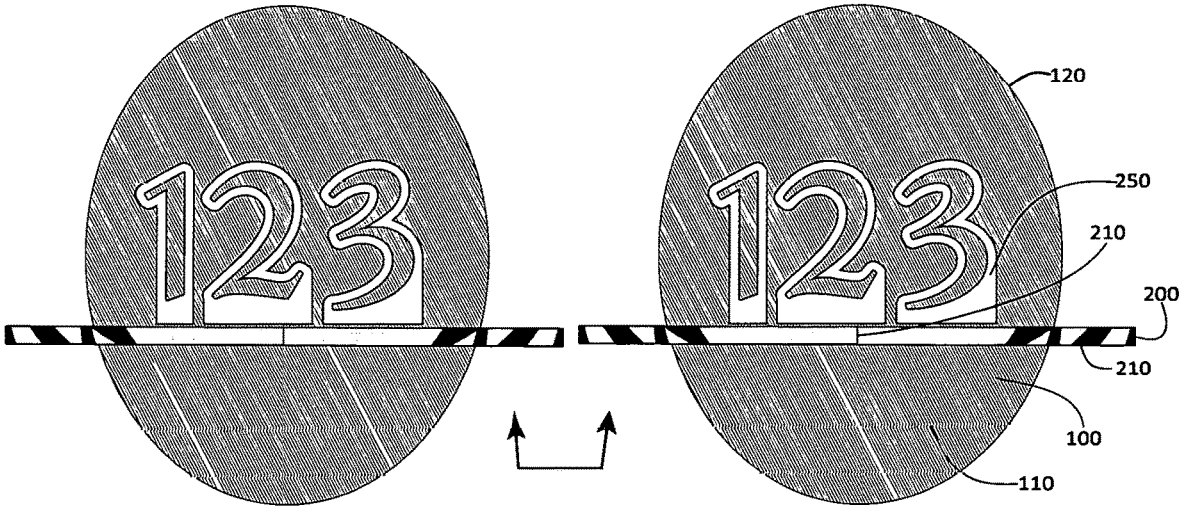
1 Simply line up the curves on the guide (OBG) to the edge of the chalkboard & place your letters along the edge of the magnet.
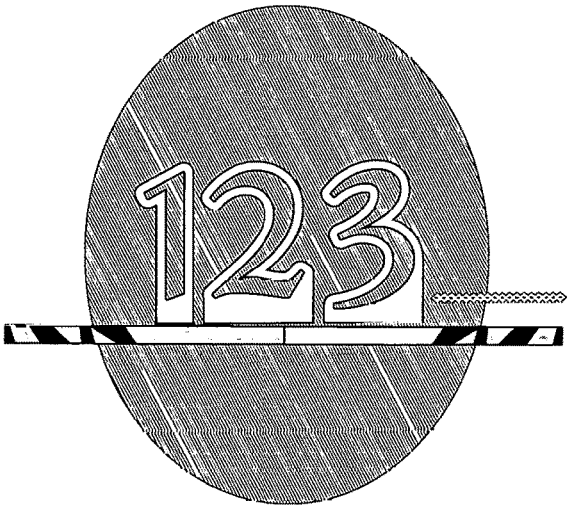
Use the OBGN to make sure your letters are centered. Using the edge of the chalkboard, measure 2
*FIG. 9*

METHOD OF STENCILING WITH A MAGNETIC STENCILING APPARATUS

PROVISIONAL PRIORITY CLAIM

Priority based on Provisional Application Ser. No. 62/755,816 filed Nov. 5, 2018, and titled "MAGNETIC STENCILING APPARATUS AND METHOD" is claimed. Moreover, the entirety of the previous provisional application, including the drawings, is incorporated herein by reference as if set forth fully in the present application.

BACKGROUND

Stenciling is a process resulting in the application of fixed designs, patterns, or text (collectively, "graphic" or "graphics" or "stenciled graphics") to a surface. In applying a stencil graphic to a graphic-display surface, a stencil template that comprises a negative-image of the desired final graphic is laid over the graphic-display surface and retained in place. Next, pigment such as paint, marker, or ink is applied to the graphic-display surface through one or more openings in the stencil template, thereby imparting in the selected pigment the desired stenciled graphic to the graphic-display surface.

Two difficulties that arise in stenciling are (i) alignment of stencil templates relative to the graphic-display surface and (ii) reliable temporary affixation of the stencil templates to the graphic-display surface.

Accordingly, a need exists for stenciling apparatus and methods that facilitate precise alignment and reliable temporary affixation of stencil templates to a surface to which a stenciled graphic is to be applied.

SUMMARY

Throughout the summary and detailed description, stenciling apparatus and methods of using them are described. Inferential reference to apparatus associated methods constitutes express disclosure of, and antecedent basis for, said apparatus, even if said apparatus is not otherwise expressly disclosed. Similarly, introduction of a physical element in the summary or detailed description includes the corresponding step of providing that element for purposes of supporting a claimed method step reciting that element. Moreover, textual references are made to various pigment-applying implements such as chalk, pencils, pens, daubers, and markers, including paint markers and chalk markers. Such implements are sufficiently ubiquitous and available that they are discussed without corresponding depiction in the accompanying drawings, but are nevertheless regarded as adequately disclosed for purposes of antecedent basis and inclusion in claims.

Various methods of stenciling in accordance with the invention include providing a substrate having a graphic-display surface to which a stenciled graphic is to be applied and at least one stencil template that is magnetically attracted to the substrate. The at least one stencil template defines a graphic negative, and includes openings therethrough corresponding in configuration to, a display graphic to be applied to the graphic-display surface. A basic method proceeds by overlaying the at least one stencil template onto the graphic-display surface for temporary magnetic affixation thereto in a desired location and orientation relative to the substrate. The desired display graphic is imparted to the graphic-display surface by applying a pigment to the graphic-display surface through the openings in the at least one stencil template. The at least one stencil template is then removed from the graphic display surface, leaving behind the applied display graphic(s).

In each of various implementations, the graphic-display surface is bounded by a discernable display-surface periphery. In some embodiments, the display-surface periphery is discernable at the extreme edge of the substrate, while in other embodiments, the substrate is bounded at least in part by a substrate frame they may extend somewhat inwardly of the extreme edge of the substrate to define the display-surface periphery inwardly of the extreme edge of the substrate.

In each of various embodiments, the substrate is a chalkboard for use by hobbyists in crafting, and may include some graphics that are permanent or semi-permanent, and others that are readily erasable and temporary. For instance, a hobbyist might want to stencil his or her family name on the graphic-display surface in a permanent or semi-permanent pigment (e.g., paint marker), while adding seasonal (e.g., holly leaves, wreaths, pumpkins, etc.) details in a more readily removable pigment such as erasable chalk. Another illustrative context in which such a chalkboard may serve as the substrate is in the food service industry. For example, a board with offerings may include some permanent or semi-permanent headings such as "specials," "beverages," "sandwiches," etc., while leaving space for less permanent information related to specifics under those categories (e.g., "turkey with one side and beverage," prices, etc.).

Various alternative stenciling methods involve aligning and spacing stencil templates relative to the display-surface periphery using at least one provided peripheral guide element. Each peripheral guide element includes mutually-spaced positioning indicia and is configured for selective magnetic affixation along the display-surface periphery. After magnetically affixing the at least one peripheral guide element to the graphic-display surface along the display-surface periphery, a user overlays and magnetically affixes the at least one stencil template onto the graphic-display surface with reference to the positioning indicia of the at least one magnetically affixed peripheral guide element. In a manner that will be more readily appreciated by reading the detailed description, the "reference to positioning indicia" may be either "direct" or "indirect." Depending on the precise circumstances of method execution—including user discretion—the at least one magnetically affixed peripheral guide element is removed from the graphic-display surface before or after the application of pigment to the graphic-display surface through an at least one opening in a magnetically affixed stencil template.

In accordance with still addition methods, stencil templates are positioned, aligned, and spaced with reference to one or more interior guide elements. Interior guide elements are similar in functionality to peripheral guide elements, but differ in positioning along the graphic-display surface. More specifically, whereas peripheral guide elements are generally positioned and magnetically affixed along and in at least general alignment with the display-surface periphery, interior guide elements either (i) are situated entirely to the interior of the display-surface periphery along the graphic display surface or (ii) extend from the display-surface periphery substantially to the interior thereof. The same physical element could be at different times implemented as either a peripheral or interior guide element. That is, in various embodiments, there is nothing inherent in a guide element that classifies it permanently as either a peripheral or interior guide element; in most cases, it is more a matter of selected placement and functionality for a particular application.

In still further implementations, the use of peripheral and interior guide elements is not mutually exclusive. That is, combinations of peripheral and interior guide elements may be magnetically affixed simultaneously to the graphic-display surface to define alignment axes and alignment grids as references for the placement of magnetic stencil templates. In the execution of some methods, a peripheral guide element may be positioned with reference to the substrate periphery, and the an interior guide element positioned with reference to the peripheral guide element. Stencil templates might then be positioned with reference to the interior guide element and/or the peripheral guide elements.

Representative embodiments are more completely described and depicted in the following detailed description and the accompanying drawings.

BRIEF DESCRIPTION OF THE DRAWINGS

FIG. 8 shows an illustrative set of instructions for the contemporaneous use of peripheral and interior guide elements including template-positioning indicia as both "direct" and "indirect" positioning references for the placement of stencil templates;

FIG. 9 depicts an illustrative set of instructions for the use of a guide element including template-positioning indicia and markings for guiding the placement of the guide element relative to the display-surface periphery of a graphic-display surface.

DETAILED DESCRIPTION

Figure 1:
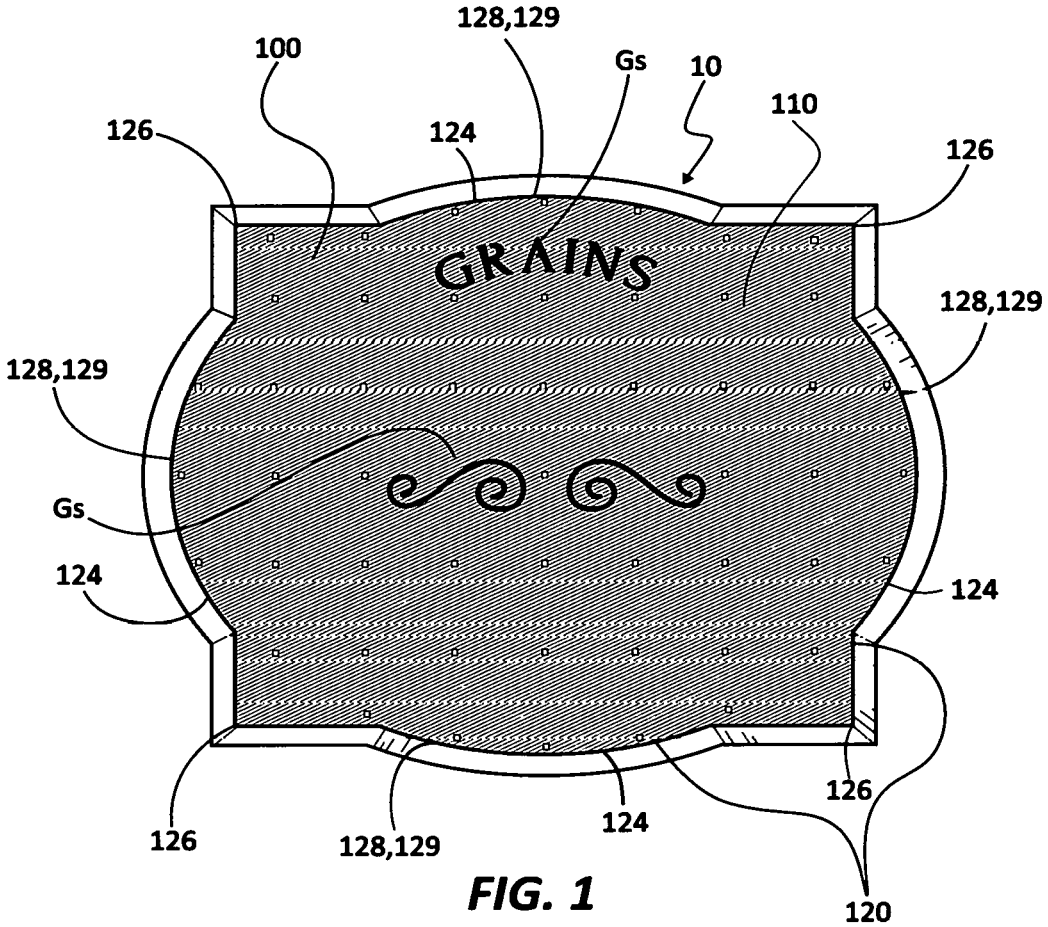
FIG. 1 shows a substrate with a graphic-display surface to which there has been applied a stenciled graphic including both textual and design aspects.

The following description of variously configured magnetic stenciling sets and associated methods is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

Shown in the included drawings are various views and illustrative versions of magnetic stenciling apparatus. Illustrative methods of use are discussed in conjunction with the descriptions and drawings of various associated apparatus.

As explained in the background and summary, there are two main issues associated with present stenciling apparatus and methods that embodiments of the present invention are configured to address. The first issue relates to alignment and placement of one or more templates on a substrate to which a stenciled graphic is to be applied, while the second issue relates to maintaining the one or more stencil templates in place in a reliable, yet readily removable way. Different embodiments of the present invention address one or both of these issues.

A basic embodiment of magnetic stenciling apparatus 10 is described with general reference to FIGS. 1 through 9. Variations on the basic embodiment are described with reference to, and in terms of their differences from, the basic embodiment. Throughout the specification and drawings, like elements across alternative embodiments are referenced by similar or identical numeric and/or alphanumeric reference characters (e.g. reference numbers). Moreover, once an element has been introduced in conjunction with a particular reference number, that same element may not be numbered and referenced with a lead line in every subsequent drawing if it is clear that the element is the same or similar throughout the drawings and description. This is do to prevent crowding in the drawings while numbering only those elements most germane to the discussion directly at hand.

As shown in FIG. 1, there is provided a substrate 100 including a graphic-display surface 110 to which a stenciled graphic $G_S$ has been applied. The particular stenciled graphic $G_S$ shown, while simple, illustratively includes both alphabetic text and non-textual shapes. It is to be understood, of course, that a stenciled graphic $G_S$ may include letters, numbers, words, or non-alphanumeric shapes. Moreover, a completed stenciled graphic $G_S$ may be a "compound graphic," which, for purposes of the present specification, is a graphic requiring the use of multiple (i.e., at least two) stencil templates used contemporaneously or in succession.

The graphic-display surface 110 is bounded by a display-surface periphery 120 within the interior of which display-surface periphery 120 the graphic-display surface 110 extends in at least two dimensions (e.g., horizontally and vertically). Application to the graphic-display surface 110 of the simple stenciled graphic $G_S$ shown in FIG. 1 is described in order to introduce and explain apparatus and associated methods within the scope of the invention as defined by various claims appended hereto.

Figure 2:
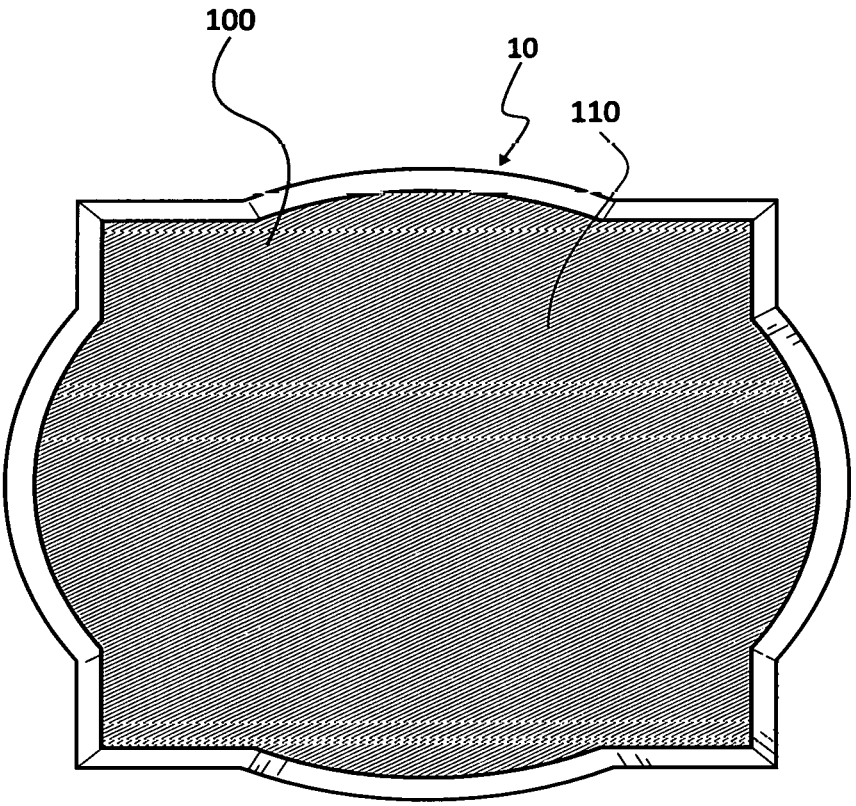
FIG. 2 depicts the substrate of FIG. 1 prior to the application of any stenciled graphic.
Figure 3A:
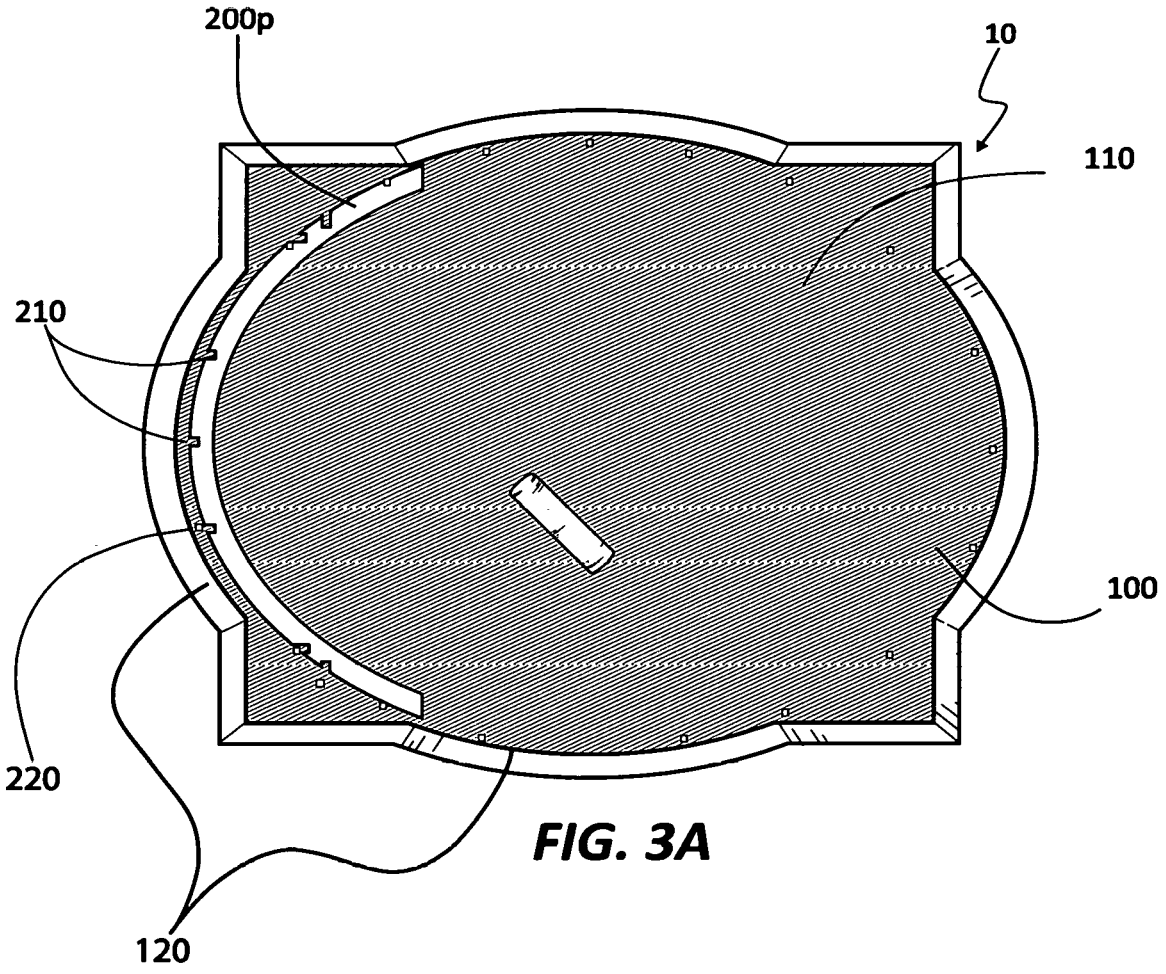
FIGS. 3A-3D illustrate various stages in the use of peripheral guide elements including template-positioning indicia in order to facilitate the transfer to a graphic-display surface temporary template-positioning marks as positioning references for the subsequent temporary magnetic affixation of stencil templates to the graphic-display surface.
Figure 3B:
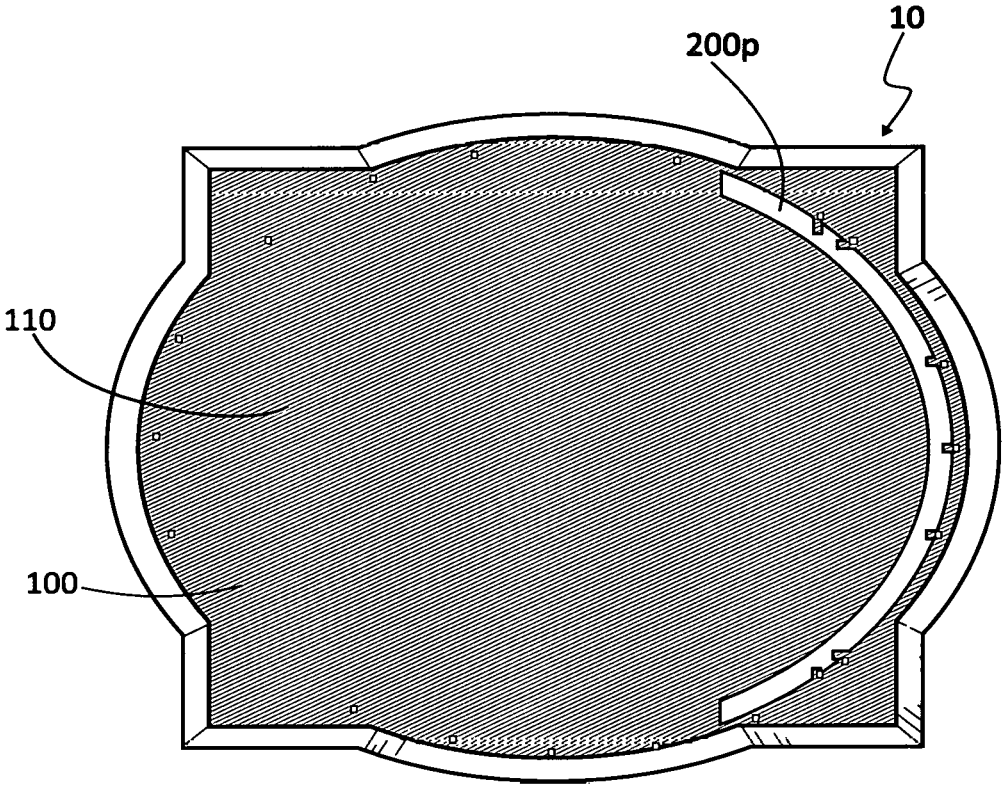
Figure 3C:
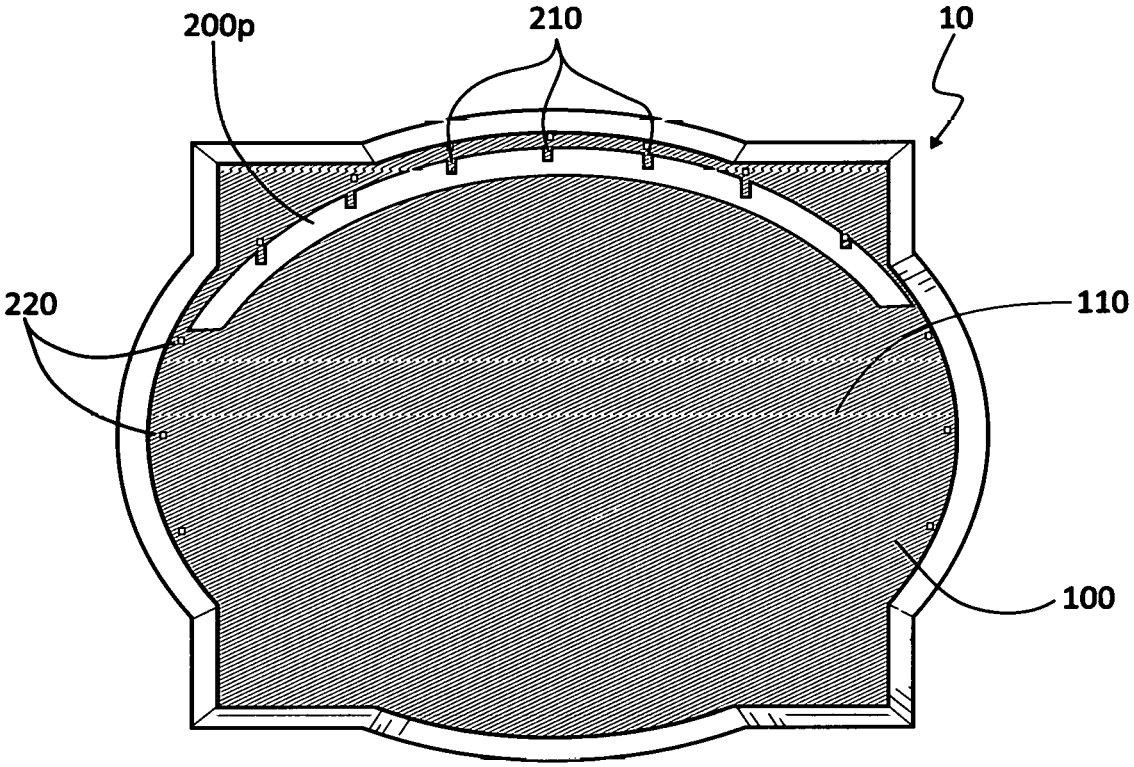
Figure 3D:
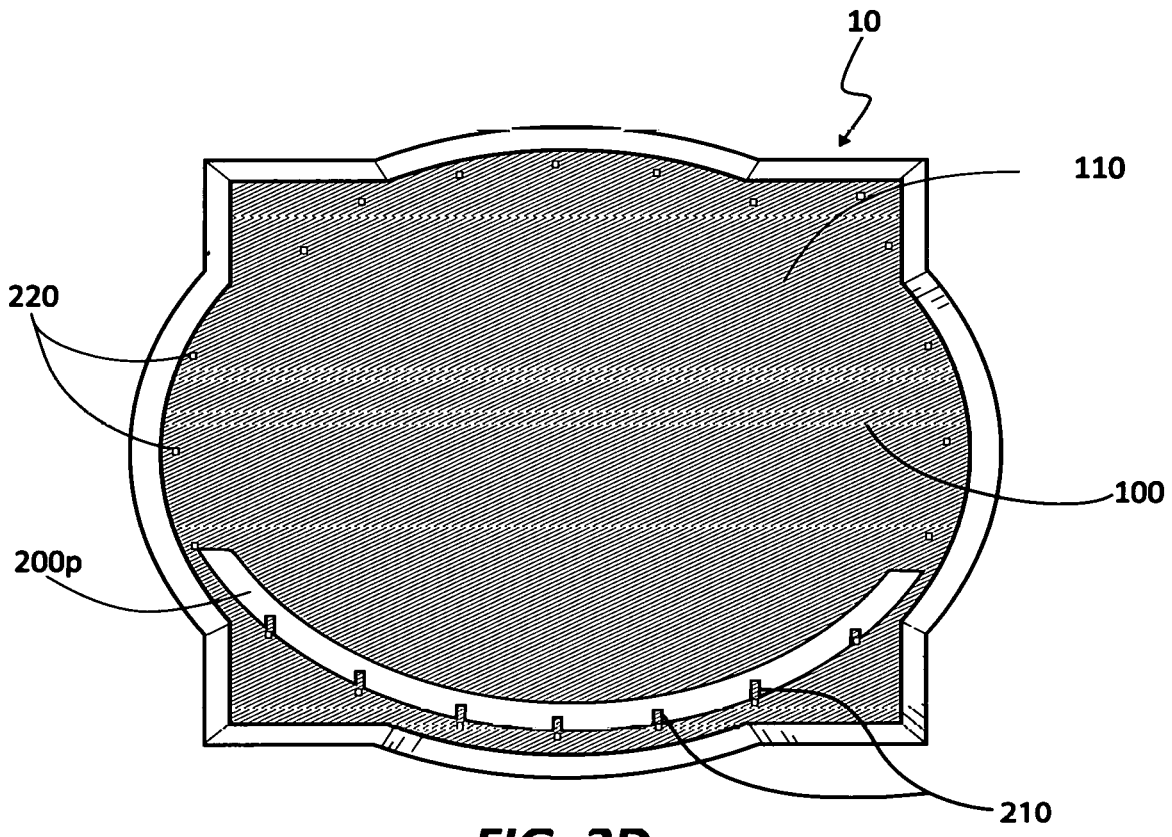

Shown in FIG. 2 is the substrate 100 of FIG. 1 prior to the application of any stenciled graphic $G_S$. The illustrative substrate 100 depicted is decoratively configured to include a non-rectangular graphic-display surface 110 bounded by a correspondingly non-rectangular display-surface periphery 120. Although not at all of central—or even tangential—importance to the novelty of the invention, the display-surface periphery 120 shown is generally inclusive of four distinct sides 124. While each set of two sides defines a "square" corner 126, a central portion 128 of each side defines an outwardly-extending arcuate portion 129.

Figure 6:
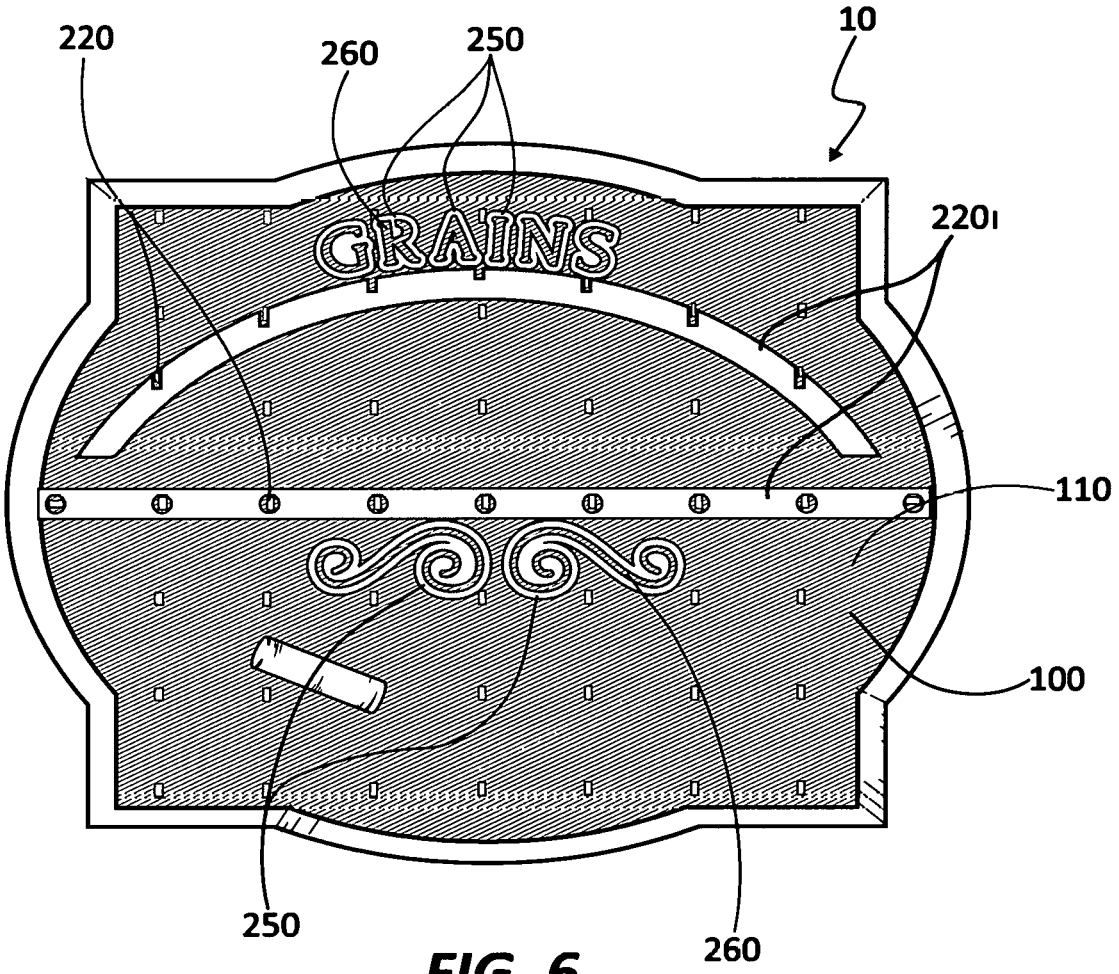
FIG. 6 depicts the magnetic affixation of stencil templates to the graphic-display surface shown in FIGS. 3A-3D, 4A-4C, and 5 using as "direct" positioning references interior guide elements as well as temporary template-positioning marks rendered by previous use of both peripheral and interior guide elements.

According to one method described in part with reference to FIGS. 3A-D, there is provided at least one peripheral guide element $\mathbf{200}_P$. Also provided, as shown in FIG. 6, is at least one stencil template 250 defining a graphic negative of, and including openings 260 therethrough corresponding in configuration to, a display graphic $G_S$—such as that shown in FIG. 1—to be applied to the graphic-display surface 110. Each peripheral guide element $\mathbf{200}_P$ includes a plurality of at least two mutually-spaced template-positioning indicia 210. In the versions of peripheral guide elements $\mathbf{200}_P$ shown, the template-positioning indicia 210 are in the form of notches, but it is to be understood that template-positioning indicia 210 could take any of various forms including, by way of non-limiting example, holes through which are applied surface markings, examples of which are discussed later in the present description, or ruled gradations similar to the applied or etched markings on a ruler or measuring tape. Moreover, each peripheral guide element $\mathbf{200}_P$ is magnetically attracted to the substrate 100 and configured for selective magnetic affixation along the display-surface periphery 120. Similarly, each stencil template 250 is magnetically attracted to the substrate 100 and configured for selective magnetic affixation to the graphic-display surface 110 within the interior of the display-surface periphery 120.

Shown in FIGS. 3A-D are peripheral guide elements $\mathbf{200}_P$ positioned and magnetically affixed to the graphic-display surface 110 of the substrate 100 in each of four different positions along the display surface periphery 120 (i.e., along each of the sides 124). The positioning indicia 210 defined along each of the peripheral guide elements $\mathbf{200}_P$ inform, or "guide," the placement of stencil templates 250 in one of a few alternative ways, an illustrative few of which are briefly discussed in turn. As will be more readily understood following the forthcoming discussion, each stencil template 250 overlaid and magnetically affixed onto the graphic-display surface 110 with "direct" or "indirect" reference to the template-positioning indicia 210 of the at least one magnetically affixed peripheral guide element $\mathbf{200}_P$.

According to one method of using a peripheral guide element $\mathbf{200}_P$, with each peripheral guide element $\mathbf{200}_P$ situated appropriately, a template-positioning mark 220 corresponding to each positioning indicium 210 of a selected set of template-positioning indicia 210 along that peripheral guide element $\mathbf{200}_P$ is transferred to the graphic-display surface 110. In many applications, such template-positioning marks 220 will be nonpermanent. For instance, where the graphic-display surface 110 is configured for use with chalk, the template-positioning marks 220 may be made with a readily erasable chalk.

Continuing in accordance with this first method, with the desired template-positioning marks 220 applied to the graphic-display surface 110, each peripheral guide element $\mathbf{200}_P$ is removed from the graphic-display surface 110. From this point, at least one stencil template 250 is overlaid and magnetically affixed to the graphic-display surface 110 with reference to the at least one template-positioning mark 220. Executed in accordance with the order of steps thus far presented, it will be appreciated that the stencil template 250 is affixed to the graphic-display surface 110 with "indirect" reference to the template-positioning indicia 210 of the at least one magnetically affixed peripheral guide element $\mathbf{200}_P$. This is because, when the at least one stencil template 250 is magnetically affixed, the at least one peripheral guide element $\mathbf{200}_P$ has already been removed from the graphic-display surface 110, and the stencil template 250 is affixed relative to the template-positioning marks 220 which were, in turn, made with direct reference to the template-positioning indicia 210 of the at least one magnetically affixed peripheral guide element $\mathbf{200}_P$.

If a stencil template 250 is affixed to the graphic-display surface 110 while a peripheral guide element $\mathbf{200}_P$ is still affixed thereto, and positioned relative to the template-positioning indicia 210 of that peripheral guide element $\mathbf{200}_P$ without transferring template-positioning marks 220 corresponding to same, that stencil template 250 is regarded as having been overlaid and affixed with "direct" reference to template-positioning indicia 210 of that peripheral guide element $\mathbf{200}_P$. Because stencil templates 250 can be magnetically affixed with either "direct" or "indirect" reference to template-positioning indicia 210 of a peripheral guide element $\mathbf{200}_P$, it is to be understood in considering the claims that, unless express language or context relative to other method steps indicate otherwise, a claim is broad enough to encompass stencil template 250 affixation with either or both of "direct" or "indirect" reference to template-positioning indicia 210.

According to a second, alternative or additional method described with reference to FIGS. 4A-C and 6, interior guide elements $\mathbf{200}_I$ are employed. Interior guide elements $\mathbf{200}_I$ are similar in functionality to peripheral guide elements $\mathbf{200}_P$, but differ in positioning along the graphic-display surface 110. More specifically, as shown in various drawings, whereas peripheral guide elements $\mathbf{200}_P$ are generally used along and in at least loose or general alignment with the display-surface periphery 120, interior guide elements $\mathbf{200}_I$ either (i) are situated entirely to the interior of the display-surface periphery 120 along the graphic display surface 110 or (ii) extend from the display-surface periphery 120 substantially to the interior thereof. Although surmisable from inspection of the drawings and by general context, it bears express notation that the same physical element could be at different times implemented as either a peripheral or interior guide element $\mathbf{200}_P$ or $\mathbf{200}_I$. That is, in various embodiments, there is nothing inherent in a guide element 200 that classifies it as either a peripheral or interior guide element $\mathbf{200}_P$ and $\mathbf{200}_I$; in most cases, it is more a matter of selected placement and functionality for a particular application, unless, for example, the display-surface periphery $\mathbf{200}_P$ is of a very unique or irregular configuration.

Figure 4A:
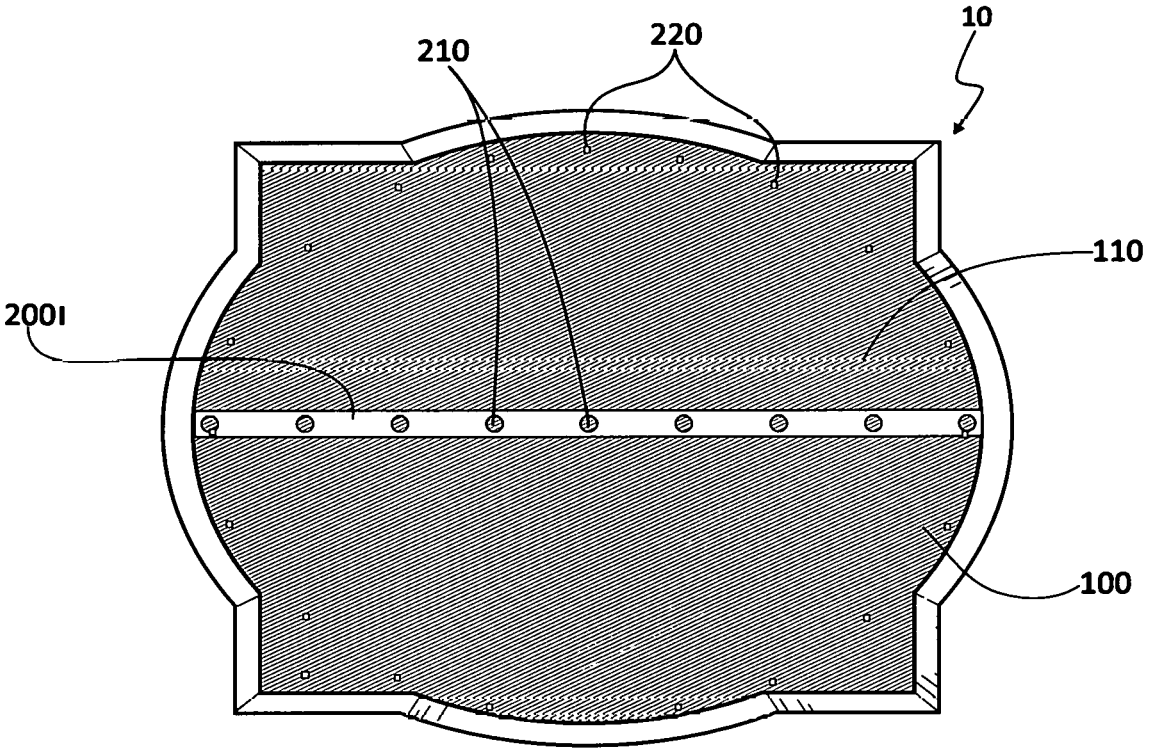
FIGS. 4A-4C illustrate various stages in the use of interior guide elements including template-positioning indicia in order to facilitate the transfer to the graphic-display surface of FIGS. 3A-3D temporary template-positioning marks as positioning references for the subsequent temporary magnetic affixation of stencil templates to the graphic-display surface.
Figure 4B:
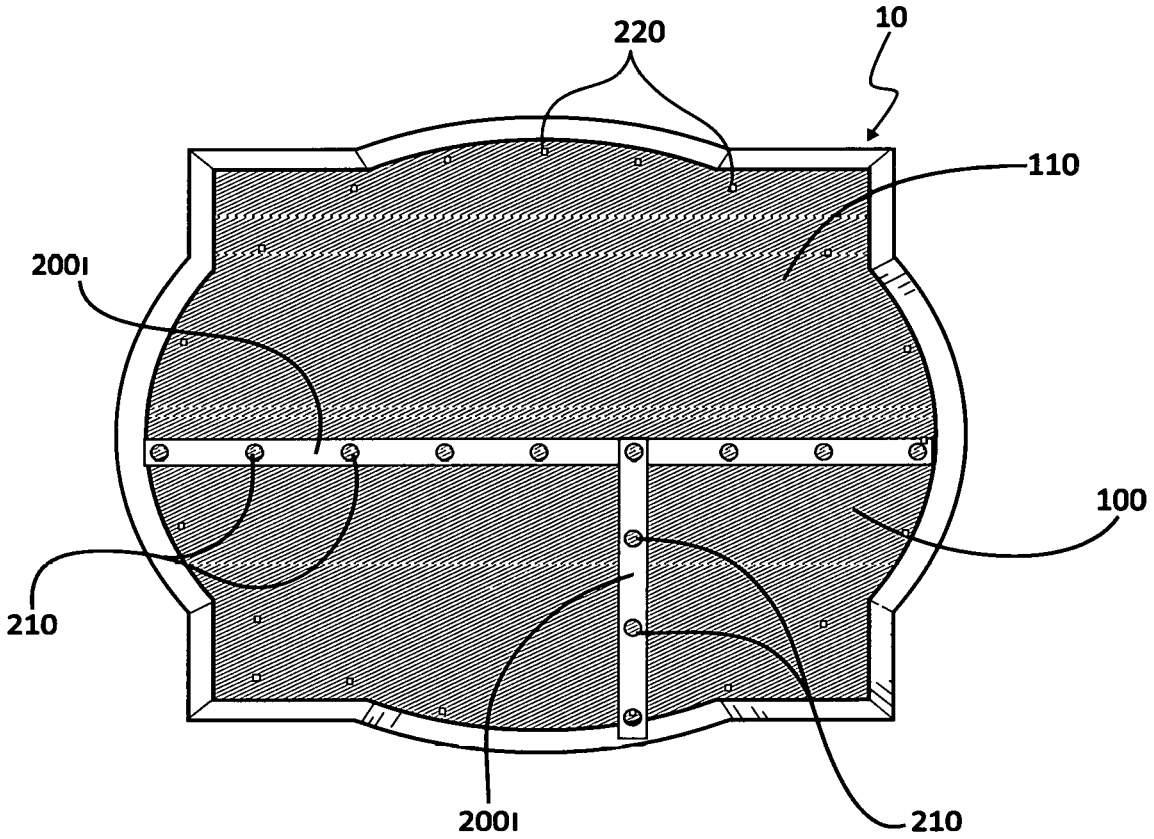
Figure 4C:
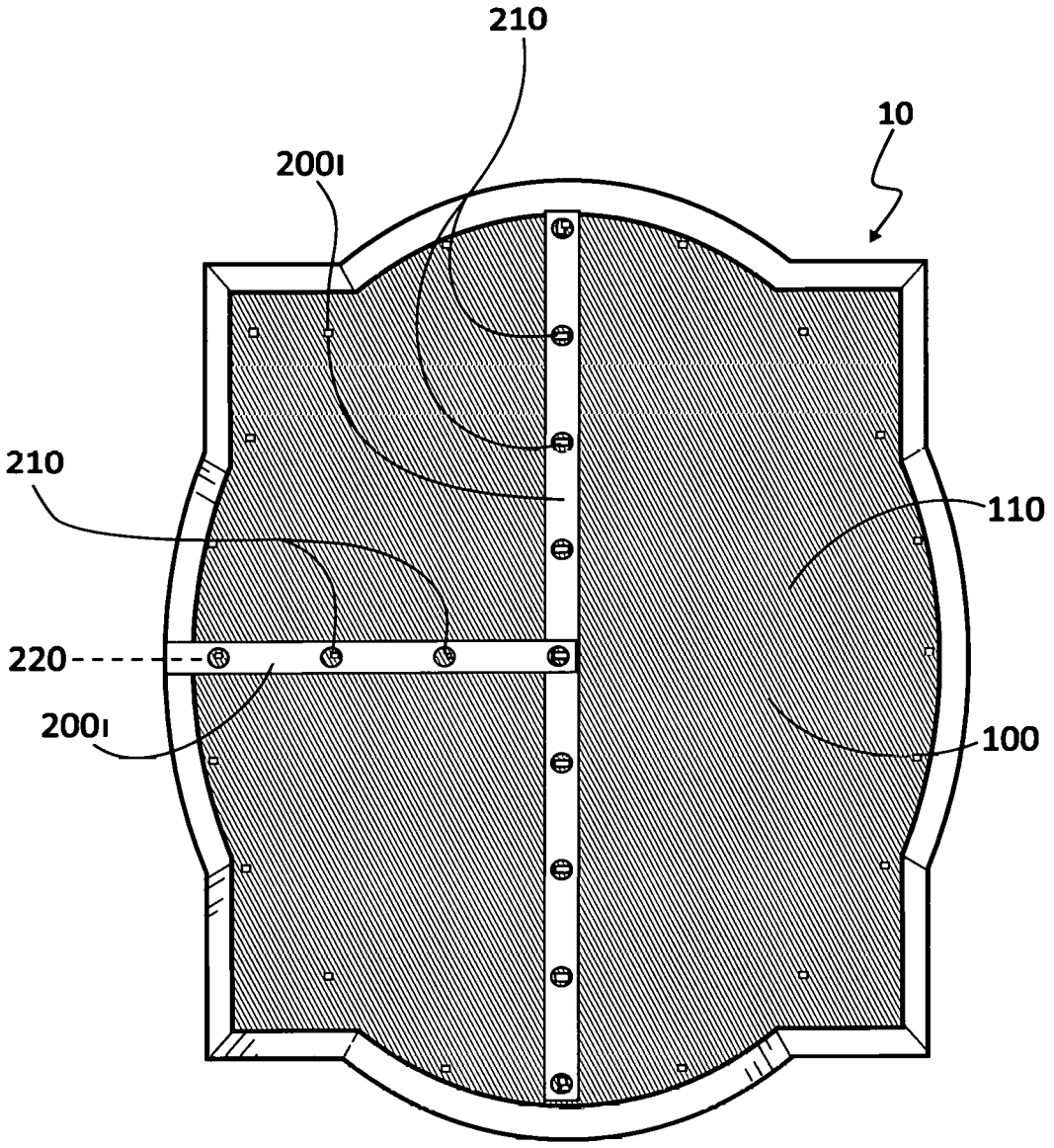

Referring still to FIGS. 4A-C, there are shown interior guide elements $\mathbf{200}_I$ overlaid and magnetically affixed in various locations along the graphic-display surface 110. For purposes of explaining their illustrative use, the interior guide elements $\mathbf{200}_I$ are variously positioned relative to peripheral template-positioning marks 220 applied to the graphic-display surface 110 as shown in FIGS. 3A-D. Like the peripheral guide elements $\mathbf{200}_P$ previously considered, the interior guide elements $\mathbf{200}_I$ include template-positioning indicia 210. Although only illustrative and non-limiting in nature, the interior guide elements $\mathbf{200}_I$ shown in FIGS. 4A-C are straight or "linear."

In any event, in accordance with this second illustrative method, with the interior guide elements $\mathbf{200}_I$ placed and temporarily affixed in various selected locations along the graphic-display surface 110, additional template-positioning marks 220 corresponding to the template-positioning indicia 210 of the interior guide elements $\mathbf{200}_I$ are transferred to the graphic-display surface 110. These interior template-positioning marks 220 are made with reference to, but to the interior of, the peripheral template-positioning marks 220 made as explained in conjunction with FIGS. 3A-3D. In the particular case of FIGS. 4A-4C, there is a single interior guide element $\mathbf{200}_I$ extending longitudinally through the center of the graphic-display surface 110.

Referring to FIGS. 4B and 4C, a laterally extending second interior guide element $\mathbf{200}_I$ long enough, in this illustrative case, to extend from a lateral portion of the display-surface periphery 120 to the longitudinally extending interior guide element $\mathbf{200}_I$ is moved into and magnetically affixed in successive positions between peripheral template-positioning marks 220 and template-positioning indicia 210 along the centrally disposed interior guide element $\mathbf{200}_I$. Additional interior template-positioning marks 220 corresponding to the template-positioning indicia 210 of the laterally extending interior guide element $\mathbf{200}_I$ are then applied to the graphic-display surface 110 as the lateral interior guide element $\mathbf{200}_I$ is affixed in each successive location. For purposes of illustration, this process is shown in the drawings to have been iterated sufficiently to create the illustrative grid/matrix of template-positioning marks 220 shown in FIG. 5.

Figure 5:
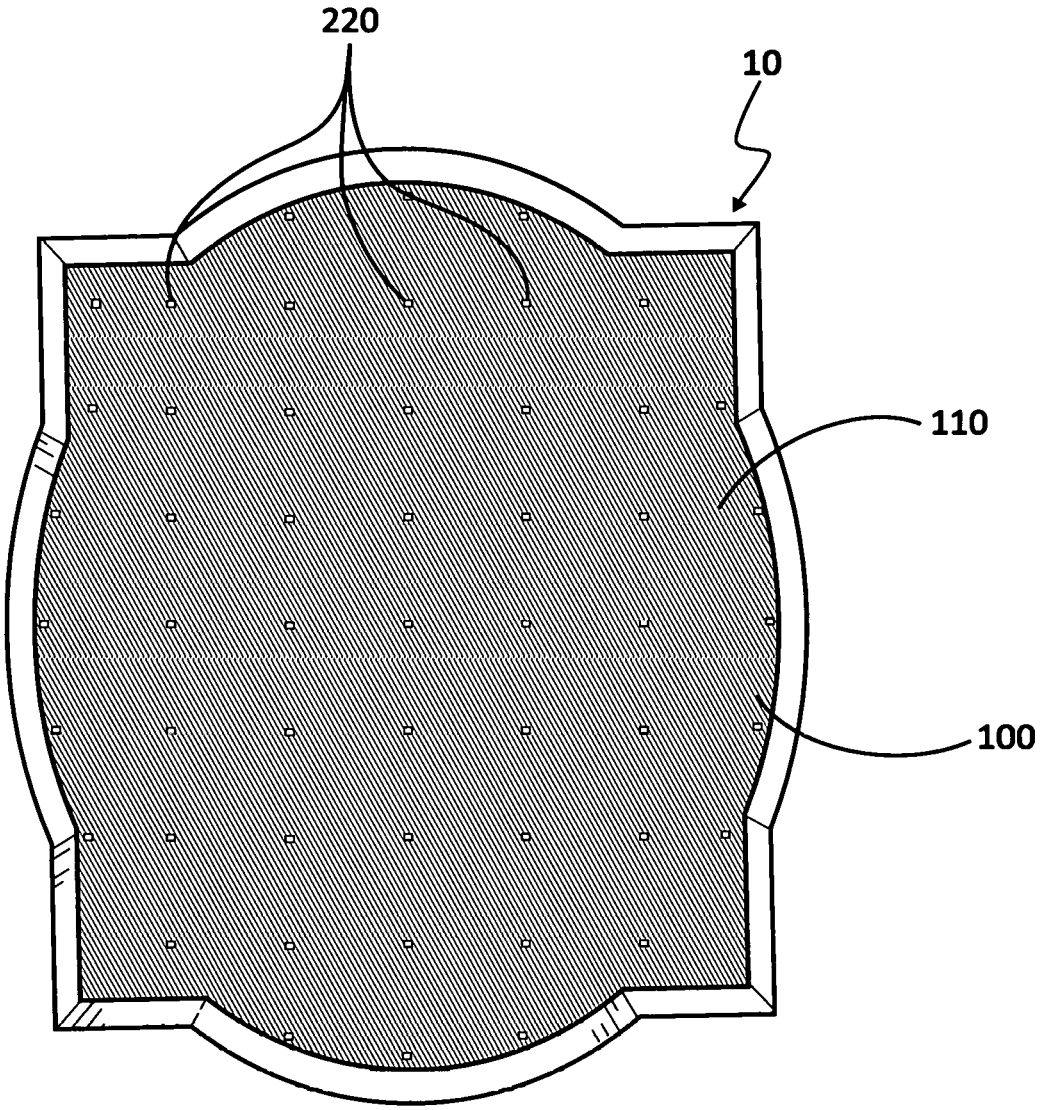
FIG. 5 shows the graphic-display surface of FIGS. 3A-3D and 4A-4C after the transfer of temporary template-position marks and the removal of the peripheral and interior guide elements.

Referring to FIG. 5, with a partial or, in this illustrative case, complete matrix of template-positioning marks 220 applied to the graphic-display surface 110, the substrate 100 is prepared to have magnetically affixed thereto at least one stencil template 250. An illustrative use of the template-positioning marks 220 shown in FIG. 5 is explained with initial reference to FIG. 6 in which stencil templates 250 configured to create the simple design shown in FIG. 1 are magnetically affixed to the graphic-display surface 110. In this case, the user has elected to have the longitudinally extending interior guide element $\mathbf{200}_I$ affixed to the graphic-display surface 110 as a direct positional reference. Additionally, the user wishes to spell the word "GRAINS" in an arcuate pattern. Accordingly, the user has also magnetically affixed to the graphic-display surface 110 an arcuate interior guide element $\mathbf{200}_I$.

With the substrate 100 in a "landscape orientation," the arcuate interior guide element $\mathbf{200}_I$ has been magnetically affixed, centered left-to-right, and "leveled" using interior template-positioning marks 220—as well as the longitudinally extending interior guide element $\mathbf{200}_I$—as positioning references. In addition to stencil templates 250 spelling the word "GRAINS," there are magnetically affixed over the graphic-display surface 110 a pair of non-alphanumeric stencil templates 250 configured for imparting to the graphic-display surface 110 a corresponding pair of mutually mirror-imaged ornamental swirl designs. As with the arcuate interior guide element $\mathbf{200}_I$, the swirl-design stencil templates 250 have been overlaid and magnetically affixed to the graphic-display surface 110 using as a positioning reference at least one of (i) interior template-positioning marks 220 and (ii) the longitudinally extending interior guide element $\mathbf{220}_I$.

Figure 7:
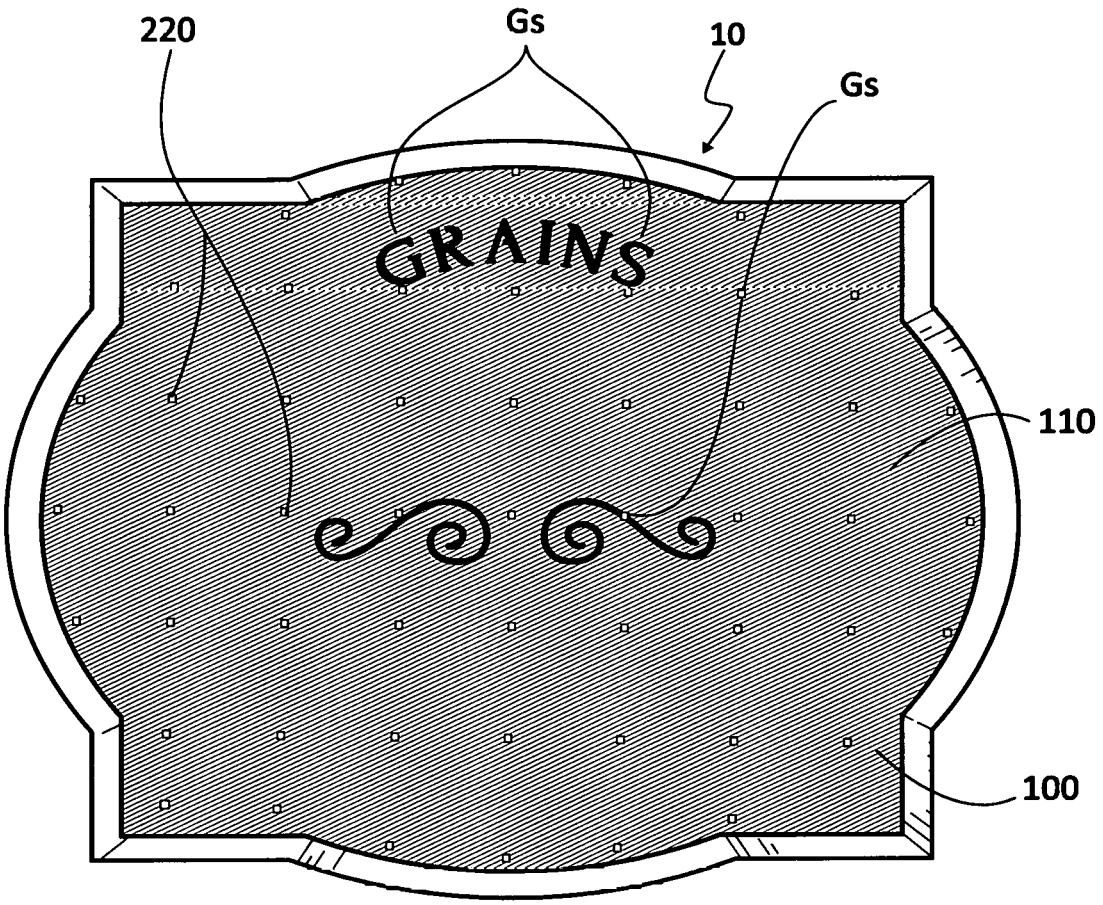
FIG. 7 shows the graphic-display surface of FIG. 6 following the application to the graphic-display surface of pigment through openings in the stencil templates shown in FIG. 6 subsequent to the removal of those stencil templates.

With the selected stencil templates 250 affixed as shown in FIG. 6, pigment is applied to the graphic-display surface 110 through the openings 260 in the stencil templates 250 corresponding to the stenciled graphics $G_S$ to be applied to the graphic-display surface 110. FIG. 7 shows the graphic-display surface 110 of the previous drawings after the pigment has been applied, and all guide elements $\mathbf{200}_P$ and $\mathbf{200}_I$ and stencil templates 250 have been removed.

At the stage of the illustrative process shown in FIG. 7, the desired design (stenciled graphic $G_S$) has been imparted to the graphic-display surface 110, but template-positioning marks 220 also remain. Some explanation of how to remove the template-positioning marks 220 without degrading the stenciled graphic $G_S$ is warranted. A major market space in which production and sale of apparatus associated with the present invention is envisioned is in the arts and crafts aimed at hobbyists. Certainly, the invention would find use in a broad array of commercial and industrial applications as well. For instance, restaurants frequently display designs and meal specials on boards to which stenciled images are applied. In any event, in one illustrative implementation, the pigments in question are chalks. "Chalk" is used broadly in the present specification and can include, for example, chalks traditionally used on chalkboards and sidewalks, as well as so-called "chalk markers."

Regardless of the pigments used, a key to successful execution of various implementations is the relative ease with which the pigments are removable from the graphic-display surface 110. More specifically, in various versions, template-positioning marks 220 are applied using a pigment that is more readily removable than is the pigment applied through the openings 260 in stencil templates 250 to impart stenciled graphic $G_S$. In cases in which chalk products are used, for example, template-positioning marks 220 may be applied with a traditional chalk that lends itself to dry erasure, while stenciled graphic $G_S$ may be applied using a chalk marker that requires a more robust effort to remove.

In terms of how they are used, chalk markers are much like other types of markers, but contain a liquid pigment adapted for application to surfaces such as chalkboards, and surfaces painted with chalkboard paint. The applied pigment from chalk markers is generally waterproof and robust enough to resist dry erasure, but removable with certain solvents and cleaners, such ammonia-based surface cleaners and solutions of vinegar. Accordingly, when both template-positioning marks 220 and stenciled designs remain on a graphic-display surface 110, the template-positioning marks 220 can be dry erased without disturbing or degrading the stenciled graphic $G_S$ design. The pigments applied for various purposes may be thought of and described in product instructions and conversation in terms of varying degrees of "permanent," "semi-permanent," and "temporary" or "non-permanent."

As briefly described in the summary, various methods may involve the contemporaneous implementation of magnetically affixed peripheral and interior guide elements $\mathbf{200}_P$ and $\mathbf{200}_I$. Shown in FIG. 8 is an illustrative diagram and set of instructions envisioned for inclusion in a magnetic stenciling kit. Such kits could variously include all or some subset of (i) a substrate 100, (ii) one or more sets of peripheral and interior guide elements $\mathbf{200}_P$ and $\mathbf{200}_I$, (iii) a set of magnetic stencil templates 250, (iv) and implements for applying pigments to the graphic-display surface 110 of the substrate. The illustrative instructions depicted in FIG. 8 are readily understood. However, these instructions are useful in illustrating how peripheral and interior guide elements $\mathbf{200}_P$ and $\mathbf{200}_I$ may be used simultaneously and cooperatively. Additionally, in such an implementation, the template-positioning indicia 210 of the horizontally oriented interior guide element $\mathbf{200}_I$ are being used as "direct" references for the placement of stencil templates 250, while the template-positioning indicia 210 of the two vertically oriented peripheral guide elements $\mathbf{200}_P$ are being used as "direct" references for the positioning of the interior guide element $\mathbf{200}_I$ and "indirect" references for the positioning of the stencil templates 250. FIG. 8 also depicts examples of disparately configured template-positioning indicia 210: (i) along the interior guide element $\mathbf{200}_I$, the template-positioning indicia 210 are in the form of holes and (ii) along the exterior guide element $200_I$, the template-positioning indicia 210 are in the form of open V-shaped notches.

Shown in FIG. 9 is still another set of illustrative instructions for use of a guide element 200 specifically marked for alignment in various locations with reference to the display-surface periphery 120 of a graphic-display surface 110. In this case, the display-surface periphery 120 does not include opposed parallel sides, like a rectangular display-surface periphery 120 would, for example. Instead, the illustrative display-surface periphery 120 of FIG. 9 is substantially oval or elliptical, and is therefore continuously defined by a curvature of varying radius.

The illustrative guide element 200 of FIG. 9 includes specialized template-positioning indicia 210 that exploit the curvature of the display-surface periphery 120 and guide proper alignment of the guide element 200 relative to the display-surface periphery 120. More specifically, the guide element 200 includes outer sets of template-positioning indicia 210 corresponding in shape (e.g. curvature) to various locations along the varying curvature of the display-surface periphery 120. When these template-positioning indicia 210 are aligned with various locations along the curvature of the display-surface periphery 120, the guide element 200 is properly positioned in various advantageous orientations relative to the display-surface periphery 120, such as horizontal or vertical relative to a "portrait" or "landscape" orientation of the graphic-display surface 110.

To the interior of the specialized template-positioning indicia 210 are template-positioning indicia 210 used as direct references for the placement of stencil templates 250 on the graphic-display surface 110. It will be appreciated that, as used in accordance with the illustrative set of instructions in FIG. 9, all of the markings shown along the guide element 200 are in one way or another template-positioning indicia 210, with some regarded as "direct" references for the placement of stencil templates 250 and others regarded as "indirect" references for the placement of stencil templates 250. Moreover, whether the guide element 200 in FIG. 9 is regarded as an interior or exterior guide element $200_I$ or $200_P$—or both—is immaterial since, as previously discussed, at least in terms of inherency, those designations are context specific. In this case, guide element 200 may be regarded as something of a hybrid; on one hand, it is aligned along and with reference to the display-surface periphery 120 and, on the other hand, it extends substantially to the interior of the display-surface periphery 120 for use of some of its template-positioning indicia 210 as direct references for positioning stencil templates 250.

Figure 10:
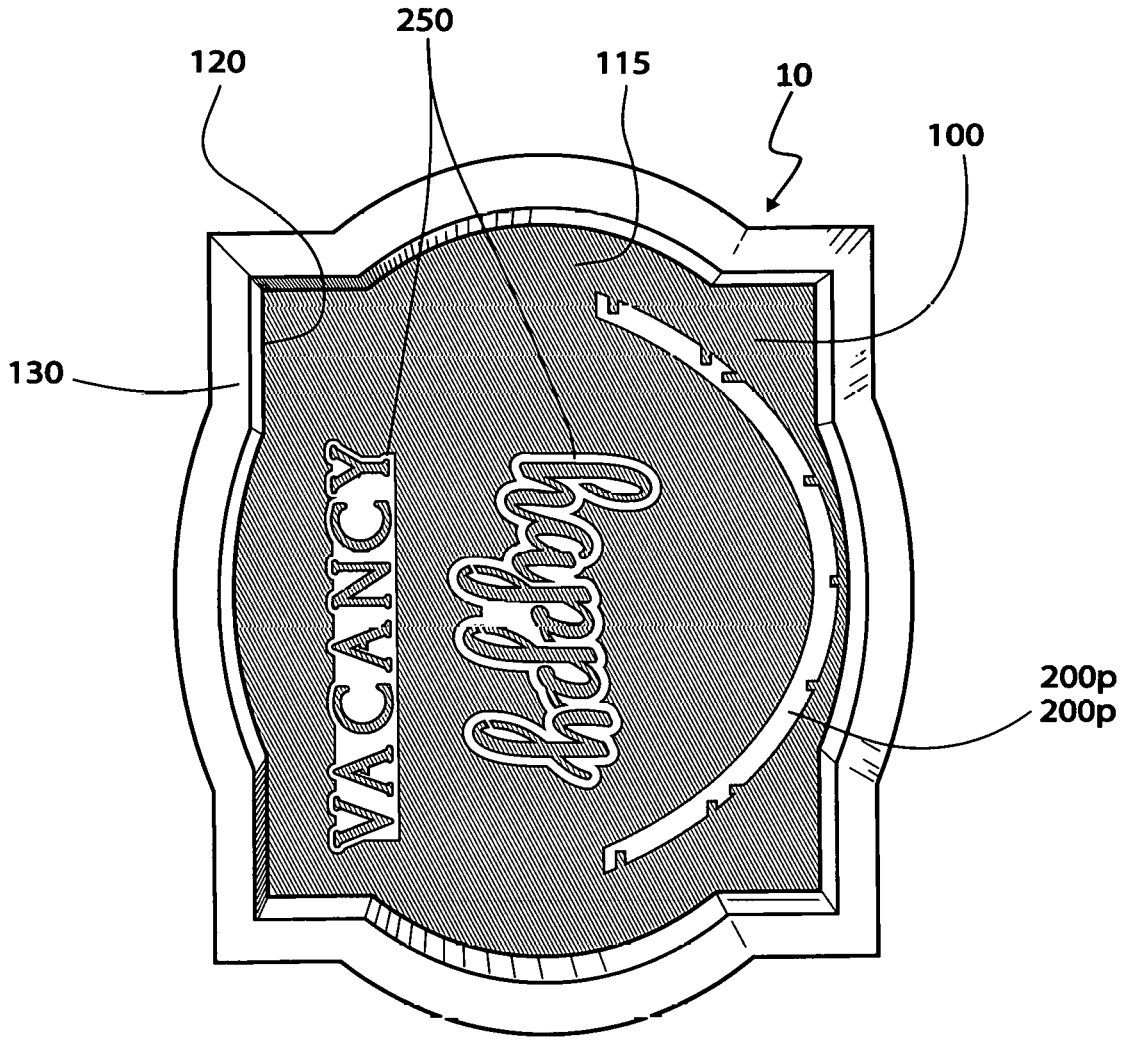
FIG. 10 depicts the substrate reverse side of the substrate shown in previous figures in order to reveal a recessed area defined by a substrate frame for the storage stencil templates and guide elements.

In addition to reliable—yet removable—retention in set positions, the magnetic attraction of the guide elements $200_I$ and $200_P$ and stencil templates 250 to the substrate 100 provides further advantages associated with various embodiments. Referring to FIG. 10, there is shown the substrate reverse side 115 (the side opposite the graphic-display surface 110) of the substrate 100. The substrate 100 includes a substrate frame 130 which, while not previously discussed, is visible in previous drawings. The substrate frame 130 extends rearward of the substrate reverse side 115 such that the substrate reverse side 115 is recessed relative to the substrate frame 130. This recess bounded by the substrate frame 130 can serve as a storage area for stencil templates 250 and guide elements $200_I$ and $200_P$, which are simply magnetically affixed to the substrate reverse side 115 as shown in FIG. 10.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A method of stenciling comprising:

providing a substrate including a graphic-display surface to which a stenciled graphic is to be applied, the graphic-display surface being bounded by a display-surface periphery;

providing at least one stencil template defining a graphic negative of, and including openings therethrough corresponding in configuration to, a display graphic to be applied to the graphic-display surface, the stencil template being magnetically attracted to the substrate;

providing at least one peripheral guide element configured for selective magnetic affixation along the display-surface periphery, each peripheral guide element including mutually-spaced template-positioning indicia;

magnetically affixing the at least one peripheral guide element along the display-surface periphery;

providing at least one interior guide element configured for selective magnetic affixation to the graphic-display surface, each interior guide element including mutually-spaced template-positioning indicia;

magnetically affixing the interior guide element substantially to the interior of the display-surface periphery of the graphic-display surface with reference to template-positioning indicia of at least one peripheral guide element;

overlaying and magnetically affixing the at least one stencil template onto the graphic-display surface with reference to template-positioning indicia of the interior guide element;

applying pigment to the graphic-display surface through the openings in the at least one stencil template to impart to the graphic-display surface the display graphic; and removing from the graphic display surface the at least one stencil template.

2. The method of claim 1 further comprising the steps of:

(i) marking the graphic-display surface with at least one template-positioning mark in a location selected with reference to at least one template-positioning indicia of an at least one magnetically affixed peripheral guide element; and (ii) removing the at least one magnetically affixed peripheral guide from the graphic-display surface.

3. The method of claim 2 further comprising the step of magnetically affixing the interior guide element substantially to the interior of the display-surface periphery of the graphic-display surface with reference to at least one of template-positioning indicia of at least one peripheral guide element and at least one template-positioning mark.

* * * * *